US010926381B2

(12) United States Patent
Wilson, Jr.

(10) Patent No.: US 10,926,381 B2
(45) Date of Patent: Feb. 23, 2021

(54) TORQUE TOOL

(71) Applicant: David Wilson, Jr., Boulder, CO (US)

(72) Inventor: David Wilson, Jr., Boulder, CO (US)

( * ) Notice: Subject to any disclaimer, the term of this patent is extended or adjusted under 35 U.S.C. 154(b) by 905 days.

(21) Appl. No.: 14/838,391

(22) Filed: Aug. 28, 2015

(65) Prior Publication Data

US 2017/0057057 A1 Mar. 2, 2017
US 2017/0225303 A9 Aug. 10, 2017

Related U.S. Application Data

(60) Provisional application No. 62/043,272, filed on Aug. 28, 2014.

(51) Int. Cl.

| | |
|---|---|
| ***B25B 13/46*** | (2006.01) |
| ***B25B 23/14*** | (2006.01) |
| ***B25B 13/08*** | (2006.01) |
| ***B25B 17/02*** | (2006.01) |
| ***B25B 13/48*** | (2006.01) |
| ***B25B 23/00*** | (2006.01) |

(52) U.S. Cl.
CPC ..... *B25B 13/467* (2013.01); *B25B 13/08* (2013.01); *B25B 13/481* (2013.01); *B25B 17/02* (2013.01); *B25B 23/0007* (2013.01); *B25B 23/14* (2013.01)

(58) Field of Classification Search
CPC . B25B 13/467; B25B 13/481; B25B 23/0007; B25B 23/14; B25B 17/00; B25B 17/02; B25B 21/002; B25B 13/08
USPC ..... 81/57.3
See application file for complete search history.

(56) References Cited

U.S. PATENT DOCUMENTS

| | | | | |
|---|---|---|---|---|
| 2,711,111 A * | 6/1955 | Brame | B25B 21/004 | 81/58.2 |
| 3,602,071 A * | 8/1971 | Juhasz | B25B 21/002 | 81/57.14 |
| 3,620,105 A * | 11/1971 | Batten | B25B 21/002 | 81/57.14 |
| 5,522,285 A * | 6/1996 | Wilson, Jr. | B25B 13/48 | 81/57.14 |
| 5,537,897 A * | 7/1996 | Wilson, Jr. | B25B 13/461 | 81/56 |
| 6,370,987 B1 * | 4/2002 | Wilson, Jr. | B25B 21/002 | 192/46 |
| 6,401,572 B1 * | 6/2002 | Provost | B25B 17/02 | 81/57.14 |
| 7,497,147 B2 * | 3/2009 | Koppenhoefer | B25B 21/005 | 81/57.39 |
| 8,080,004 B2 * | 12/2011 | Downey | A61B 17/00234 | 606/1 |

* cited by examiner

*Primary Examiner* — David B. Thomas

(57) ABSTRACT

A reciprocating apparatus for high torque transfer to a fitting, including tightening or loosening, having two coaxially synchronized engageable drive members provided with a sector geared radial flange engageable with an engageable rotatable drive gear, one internally supported split ratchet gear and drive socket maintained in contact with a spring biased ratchet pawl, together simultaneously rotatable in a first driving direction and independently disengageable in a second direction for reciprocative advancement of a ratchet geared socket in driving engagement with a fitting.

15 Claims, 8 Drawing Sheets

TORQUE TOOL

FIELD OF INVENTION

This invention relates to fitting manipulating apparatuses such as wrenches, sockets and socket drivers, and more particularly, relates to slotted ratchet wrenches operable with fluid fittings, fasteners, valves, connectors, pumps and the like.

BACKGROUND OF THE INVENTION

Originally, tube fittings were installed onto valves, "T"-unions, cross unions and adapters connecting tubing with only two hand wrenches. One wrench used to hold the fitting body and other wrench to tighten the fitting. Torque values were determined by the mechanic's sense of feel. This resulted in varied results from one mechanic to the next. This required that the mechanic have enough space to manipulate two open end wrenches without obstruction.

When inadequate space was available, the mechanic would remove adjacent obstructions until enough working room was created to manipulate wrench handles. Thereafter, installing the fittings and finally, replacing the components that were removed would be reinstalled which wasted both time and money. Hereafter, in 1951 Herbert Fish invented a split ratchet wrench U.S. Pat. No. 2,708,855 which was slotted at one end so that a mechanic could place the wrench on to a fitting while having a fluid line inserted into the fitting. The slotted ratchet tool allowed faster assembly since it was compact, and minimized dis-assembly to gain enough room to work on fittings, valves, pumps and the like. Since then, other improvement patents for this tool have been granted including Brume U.S. Pat. No. 2,691,315, Fish U.S. Pat. No. 4,085,784, Fish U.S. Pat. No. 4,188,703, still others have sought to improve this basic hand tool.

As aircraft, ships, and trains got bigger so did the need for higher fuel flow rates and therefore the size of the tubing and the fittings got larger and so did the torque required to adequately tighten these fittings without having leaks. Fitting sizes finally reached a point where manual assembly started to become extremely difficult or even impossible. The torque required to install some fittings exceeds 250 ft. lbs. and as a result, these manually operated ratchet tools reached the limit of their utility.

Mechanics attempting these tasks would need to hold the fitting body with one wrench, and then attach a second wrench to the fitting required to tighten the nut and apply 250 ft. lbs. of force to the end of the wrench. Since this is nearly impossible, wrench extensions two feet long still required 125 pounds of force to rotate the wrench handle. The major problem is that many operating envelopes provide less than ten inches of total clearance around the perimeter of the fitting, thus again stopping the assembly.

What is needed is an open ratchet wrench torque multiplier that provides all the benefits of an open end ratchet tool and a mechanism for increasing the output torque of a tool that eliminates the need for a long wrench extension to operate. Therefore, by providing a compact tool useful for developing high torque in close quarters, which would be crucial for some assemblies requiring high precision in confined areas.

The present invention is a conceptual and structural improvement that advances old technology into a new state of the art assembly tool that provides safety benefits to mechanics and cost savings to employers.

SUMMARY OF THE INVENTION

Described is a powerful and highly compact method of rotating a ratcheting crowfoot style wrench housing with integrated gear teeth cut around the perimeter of a portion of the wrench housing. The new invention is an effective driver for fixed jaw or ratcheting open-end crowfoot style wrench heads. The present invention enables the application of precise torque values while installing fluid fittings with common hand tools, or easily adapted for engagement by electric or pneumatic power tools.

The present invention is comprised of two detachable components. A first sector geared ratchet drive housing, and second pivot base. Each of the components is provided with specific features to allow the two components to engage with a fitting connection to facilitate accurate guided rotation of the fitting to completion of a specific torque value, while functioning as a coupled unit. The second component is used to hold the body of the fitting in a stationary position. This second component includes a slotted hub, arm, and a mount for a rotatably supported drive gear. The drive gear is provided at the end of the arm opposite the slotted opening in the hub. The hub is slotted to provide engagement with a non-rotatable feature of the fitting body, (for instance the center nut of the fitting). The drive gear is disposed at the end of the arm. The drive gear is positioned at a distance from the center of the slotted hub equal to the specified gear mounting distance required for meshed engagement with a sector gear, which extends around a portion of the outer perimeter of the housing of the first component.

The first driving component is comprised of a ratchet housing adapted for simultaneous, synchronized dual action rotation of the housing and ratchet toothed drive socket. Both the ratchet socket and sector geared housing are slotted equally at a forward end to allow placement onto a closed circuit of tubing to engage a fitting. The outer housing perimeter is provided with a series of gear teeth opposite the slotted forward opening of the drive housing. The bottom face of the drive housing includes a huh receiving pocket to allow the drive housing to coaxially reciprocate clockwise and counter clockwise around the slotted hub to the extents of the sector gear teeth. This allows the tool to operate in either a forward or rearward direction while pivoting around the outer perimeter of the slotted hub of the second component. This enables reciprocating movement of the drive housing to repeatedly re-engage spring biased ratchet pawls and drives the ratchet toothed socket. The inner ratchet socket is supported for rotation on the hubs within the drive housing to enable rotation of a fitting in a continuous first direction. The housing is configurable for either tightening a fitting or loosening a fitting. The ratchet toothed drive socket is supported for rotation within the body of the sector geared drive housing on slotted circular hubs extending from each face of the ratchet toothed drive socket. A first hub is disposed within an annular race within the drive housing and the second hub extends outwardly beyond the cover of the upper face of the housing providing an extended drive socket for engagement with a fitting nut during installation or removal. A locking mechanism is provided for maintaining the slotted hub pocket of the first component in rotative alignment with the hub of the second component.

Together, the two components are individually attached to a fitting with the second component engaged on the fitting body, or non-rotatable nut and the first component engaged with the flats of the rotatable hexagonal fitting. The two components and the fitting are engaged together for cooperative interaction functioning as an integrated assembly apparatus for fittings, fasteners or nuts. This enables the second stationary component having a slotted hub and pinion drive gear to be maintained in coaxial alignment with the fitting while concurrently maintaining meshed engagement with the pivotally supported sector geared ratchet housing (first component).

Various configurations of the present invention are possible depending on the torque required to complete a fitting installation. Fittings requiring high torque values are achieved by attaching a planetary torque multiplier to the present invention. Additionally, high accuracy torque output values are enabled with the addition of an electronic strain gauge or a mechanical clutch. Fittings that do not require high torque values can be installed without the addition of a torque multiplier by utilizing the basic mechanical advantage provided by the tool's pinion drive gear engaged with the sector gear of the ratchet drive housing providing a 5:1 mechanical advantage in a basic configuration and torque multiplication is variable during design of the tool to meet specific requirements. The intent of the present invention is to provide a tool that can be placed on a fitting connection attached to a tube or hose fittings to ensure accurate tightening of a fitting by applying a measured torque value to the fitting.

The sector geared ratchet drive housing can be configured with left or right hand ratchet teeth allowing the socket to rotate a fitting in either a continuous clockwise or counterclockwise direction depending on the need for installation or removal of a fitting. Alternative adaptations provide for drive housings that are intended to be inverted for reversing rotation of driving direction. In other circumstances, the ratchet drive housing can be provided with switch selected dogs and a universal ratchet tooth design enabling selection of left or right rotation without leaving placement on an engaged fitting.

Accuracy of the present invention is verified by comparing the measured input torque applied through a coupled strain gauge and comparing the output torque measured at the hexagonal output drive socket of the ratchet gear with a torque testing machine. This allows the tool to be certified for torque accuracy to confirm repeatability. In factory assembly environments, the input torque delivered to the planetary torque multiplier is easily regulated with a spring biased clutch, thus allowing output torque to be limited to a peak value based on the ultimate release point of the clutch.

The present invention is provided as a manual assembly tool for use in confined spaces to eliminate use of air hoses, hydraulic hoses and drive motors to keep the size of the tool at a minimum for ease of use. In areas where work space is accessible, the tool is easily adapted for attachment to a wide range of power tools. For instance, the planetary torque multiplier could be attached to an electric nutrunner, or hydraulic tool each of which is well known within the art.

Slotted sector geared ratchet drive housing is provided with a semi-arcuate section of gear teeth around its perimeter at a position opposite the slotted opening of the housing. The bottom face of the housing is provided with pivoted blades for capture or release of a slotted circular pivot hub established for maintaining the sector geared ratchet housing in meshing contact with an arm supported drive gear. In one embodiment, a drive gear is coupled with a planetary torque multiplier to provide torque multiplication by rotation of an input shaft which is monitored by a torque sensing strain gauge to allow workers to accurately apply precise, torque values to B-nut fluid fittings and other types of center obstructed fasteners.

When fitted with optional accessories such as electric or pneumatic reciprocating drive, assemblies, the present invention is easily adapted for automatic reciprocating rotation of the geared housing to advance the ratchet drive socket of the tool in a constant clockwise direction. Ratchet wrench heads are provided with locking pawls configured for either clockwise or counterclockwise rotation; or can be universally adapted by simply inverting the wrench head to facilitate installation or removal of fittings. Various configurations of the present invention include a fixed jaw crowfoot head with a sector geared rear annulus, and is coupled with an alignment pivot hub and driven with an arm supported spur gear to engage with the sector gear case of a ratcheting crowfoot or a sector geared non-ratcheting crowfoot. In yet another embodiment, a worm gear can be used to rotate a worm tooth sector around the perimeter of the ratchet housing. Other configurations allow the base hub to engage with various styles of fluid fittings such as elbows; "T"-unions and cross unions.

DETAILED DESCRIPTION OF THE INVENTION

The invention will now be described by way of example with reference to the accompanying drawings showing a preferred embodiment of power wrench assembly.

Figure 1:
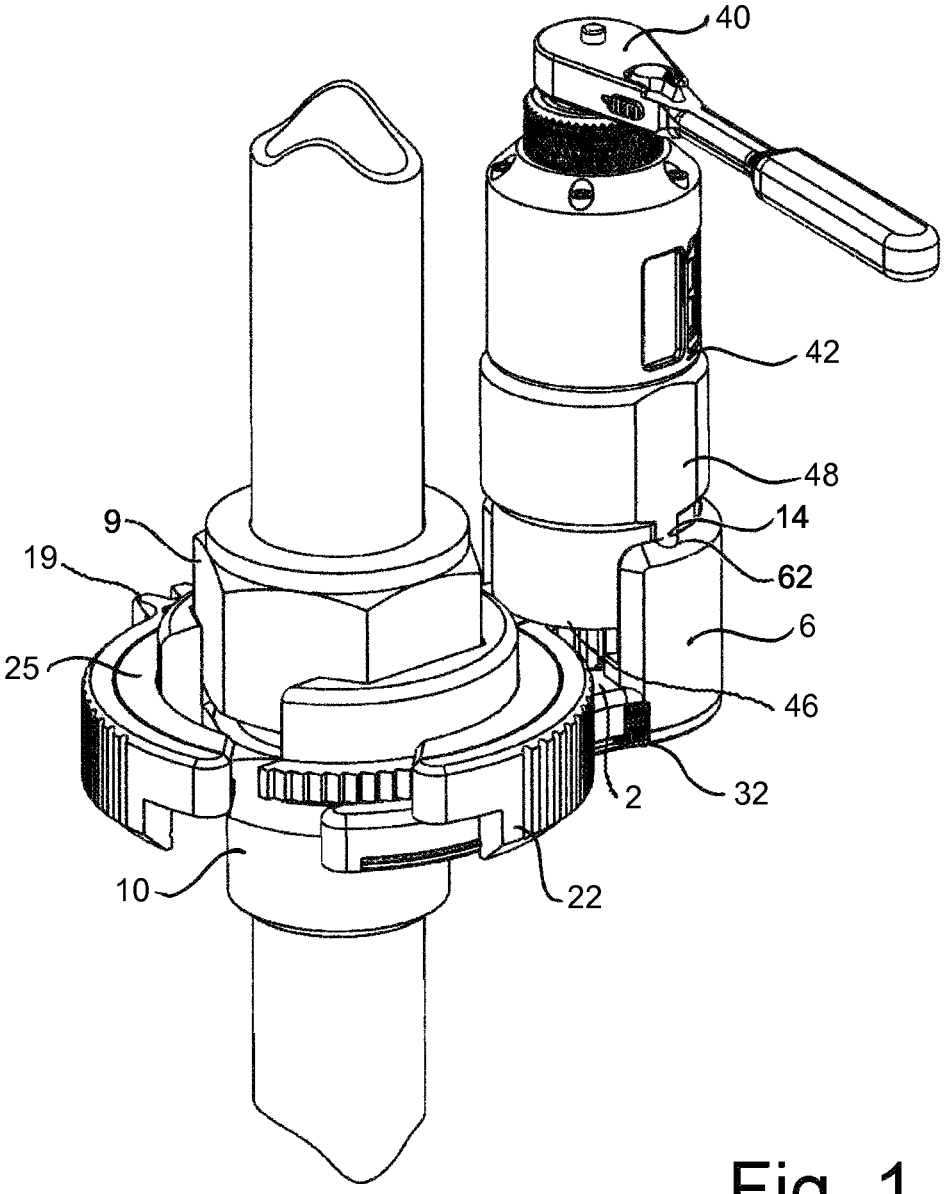
FIG. 1: Torque tool of the present invention driving a fitting.
Figure 2:
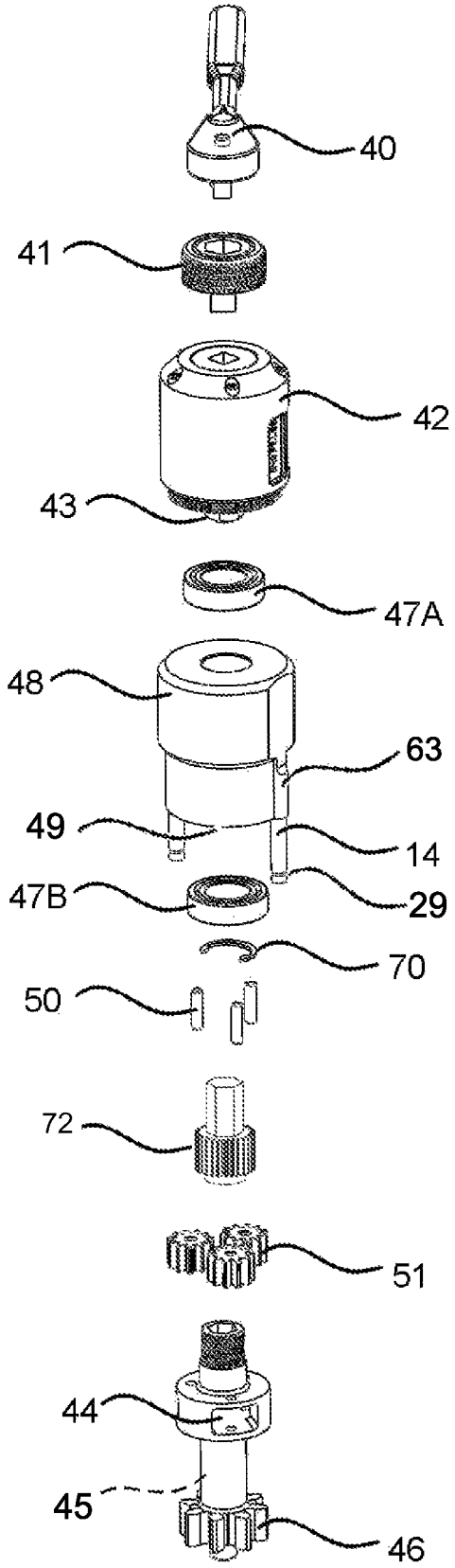
FIG. 2: Exploded view of planetary multiplier, and strain gauge module.
Figure 3:
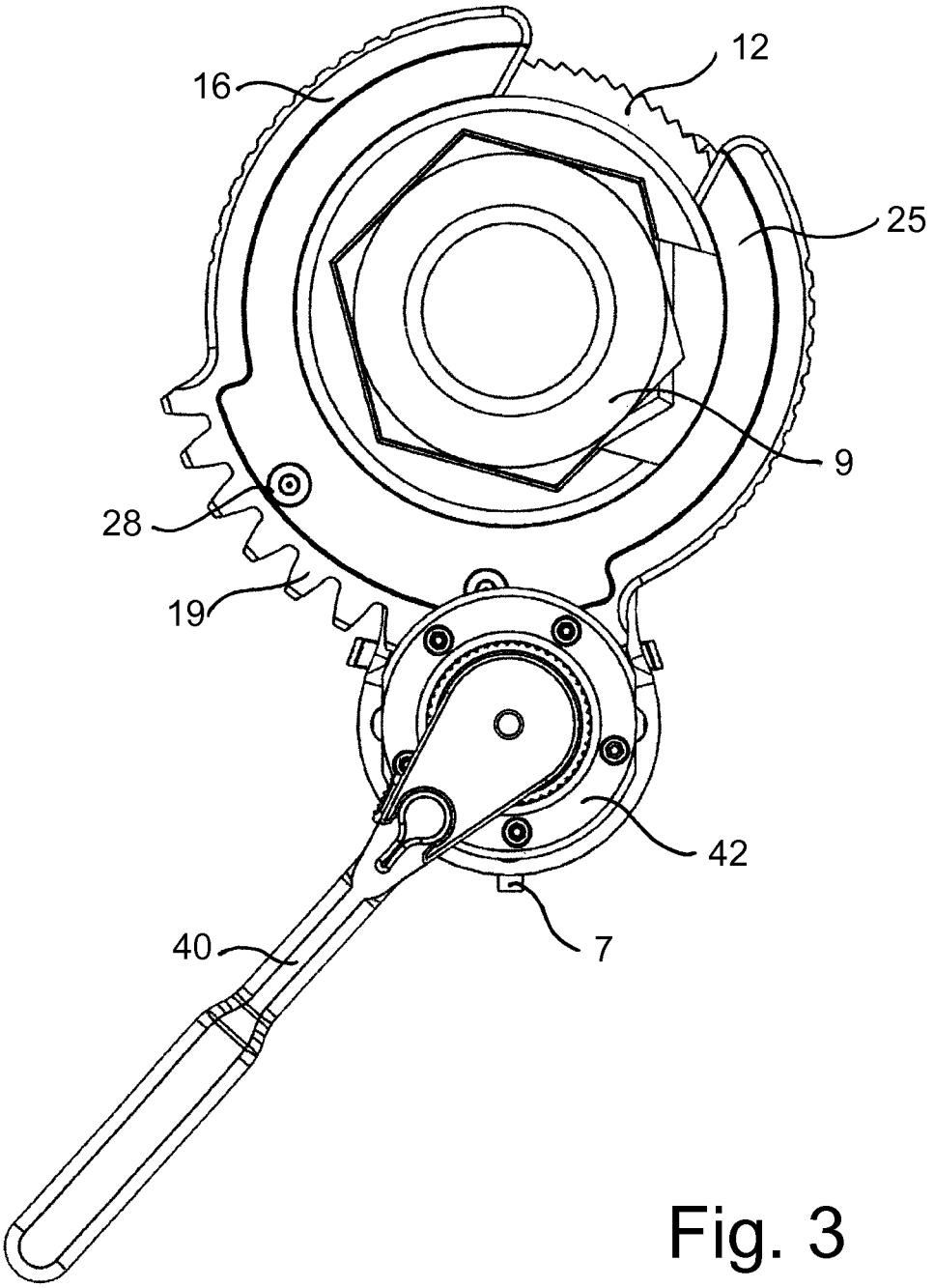
FIG. 3: Top View, Sector gear at clockwise limit.
Figure 4:
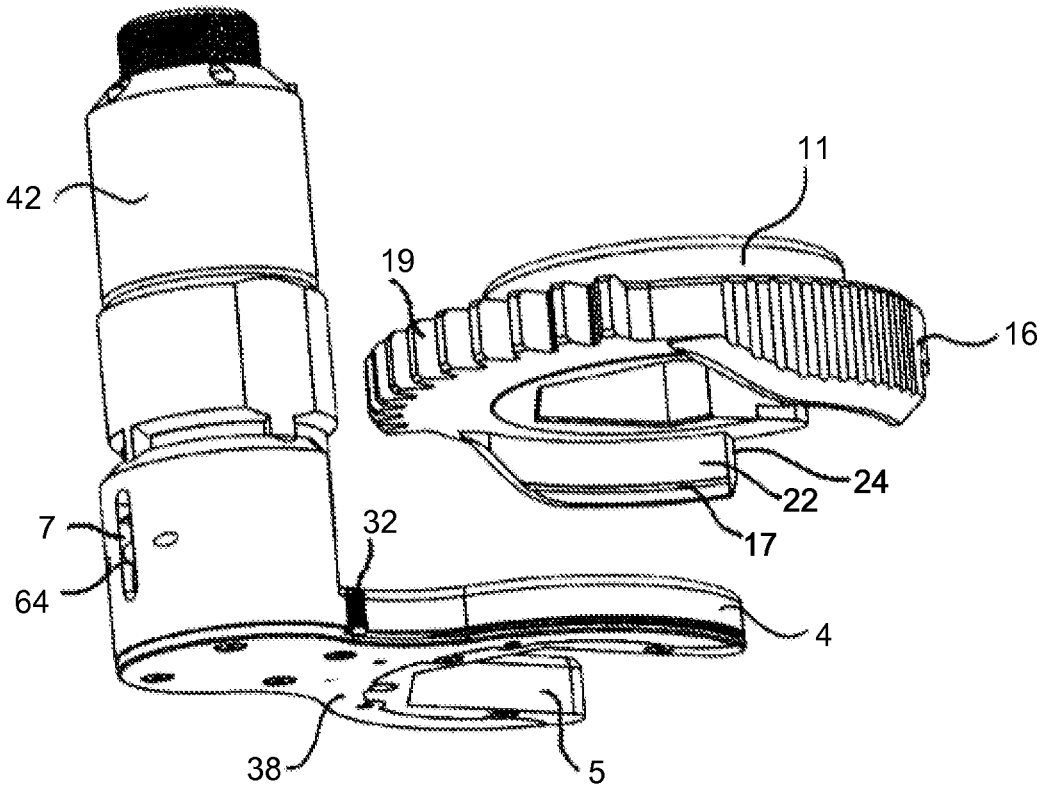
FIG. 4: Side View, Uncoupled housing and drive.
Figure 5:
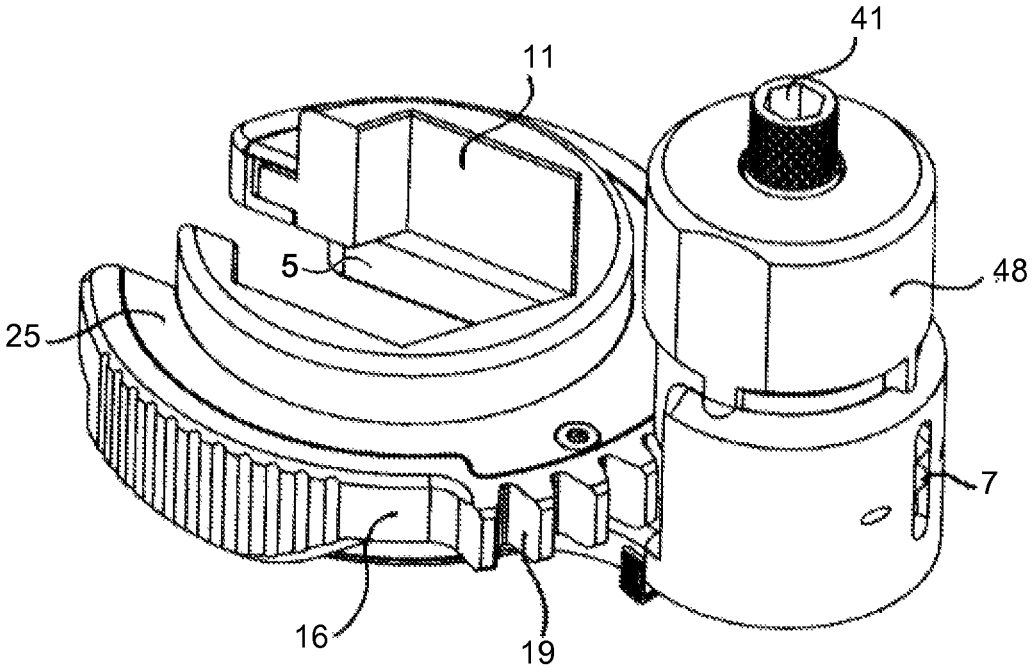
FIG. 5: Coupled housing and drive, shown without planetary.

The body of the ratchet housing 16 is provided with an outwardly extending flange forming a sector geared annulus 19 around the outside perimeter of the housing at a position opposite the slotted opening 24 at the front of the housing extending into a ratchet gear hub receiving counter bored pocket 15 that is provided in the upper surface of the housing for rotatably enclosing a ratchet wheel 12 provided with upper and lower hubs, FIG. 4 which extend into circular openings at a first end into the housing and through the housing cover 25 at a second end provided to support rotation of the hubs. Two spaced apart pockets 16 are counter bored into the housing to hold spring 27, FIG. 7 biased and pivoted ratchet dogs 26 in contact with an inserted slotted ratchet wheel 12 to translate reciprocating rotation of the sector gear ratchet housing engaged in contact with the pinion gear 46, FIG. 2 to incrementally advance the toothed ratchet wheel 12 in a continuous clockwise or counterclockwise direction. The lower surface of the ratchet housing 16 opposite the cover is provided with a slotted hub receiving pivot pocket 23. The pocket is comprised of two diametrically opposed arcuate walls 22 sized for receipt of a slotted pivot hub 4 the slotted pivot hub having an arm 3 extending a length coincident with the mounting distance of a rotatably supported pinion gear, mounted on a circular platform in a bearing in meshing engagement with the sector geared housing 16. The support arm 3 for supporting the pinion gear is formed integral with the slotted circular hub 4. The hub includes two spaced apart side walls spaced for engagement with a non-rotatable feature 10 of a fitting.

Figure 6:
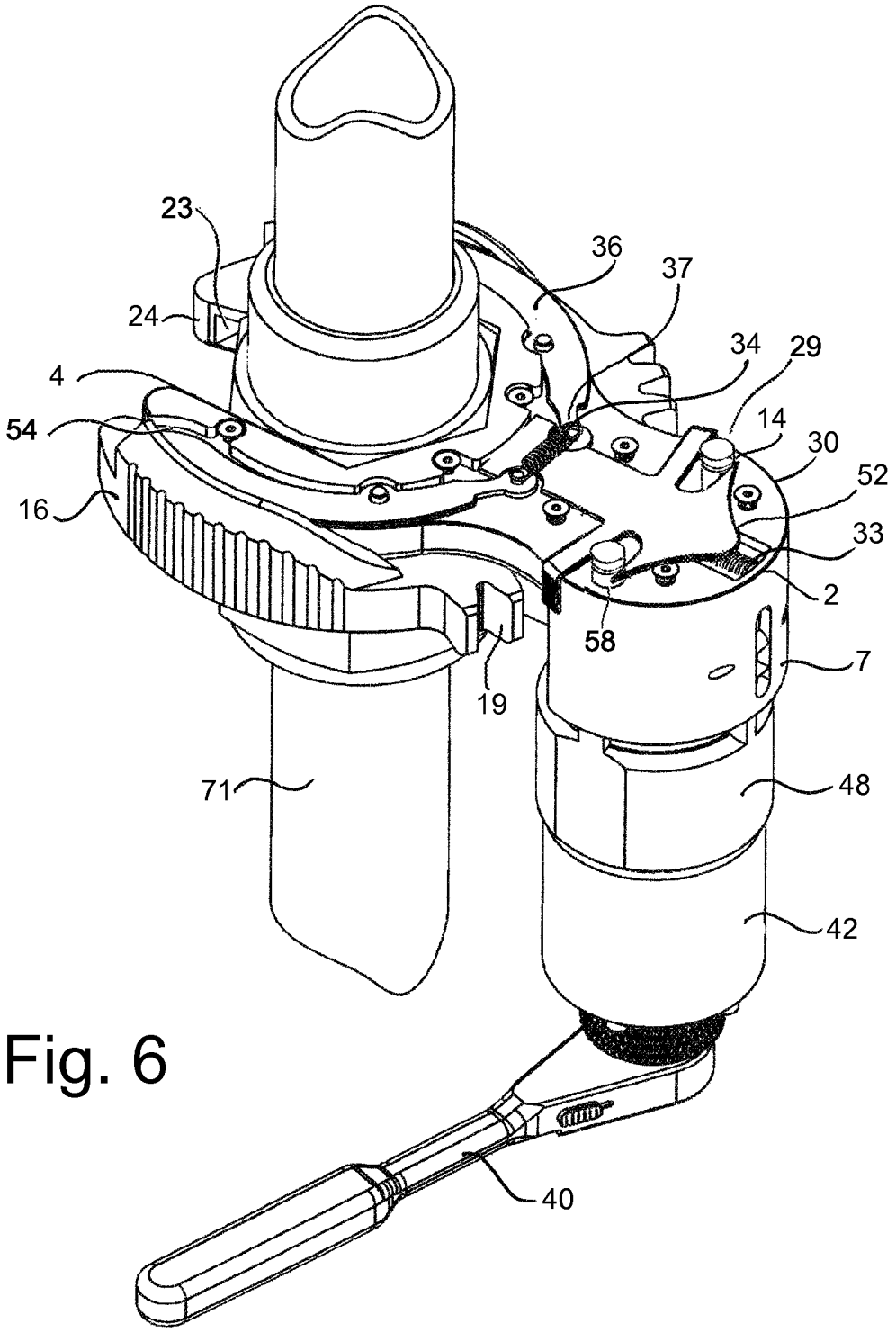
FIG. 6: Bottom View, locking mechanism blades extended.

When the slotted hub 4 is inserted into the hub receiving pocket 23 established by the downwardly extending arcuate walls 22 two diametrically opposed arcuate walls are spaced apart at a distance for close rotating engagement with the slotted hub 4 to insure accurate rotation and co-axial alignment with the sector geared ratchet housing 16 when reciprocatively pivoting around the perimeter of the slotted hub. This allows the two components to be operatively coupled together by a locking mechanism (see FIG. 6) comprised of retractable pivoted curved blades 36 that are actuated with a spring 33, biased key 30 enabling forward and aft movement of the key, while interacting with the pivoted blades 36 resulting in extension or retraction of the pivoted blades into radial slots 17 as seen in FIG. 4 provided with the inner annulus of the spaced apart walls 22 of the sector geared ratchet housing 16 (see FIG. 6). These cooperating components are arranged to allow forward travel of the key 30 to make contact and bias the curved blades 36 at a first end resulting in the blades pivoting into position with radial slots 17 along the inner perimeter of the walls of the hub in the receiving pocket. When key is moved rearward out of contact with the curved blade ends, the blades pivot out of contact with the slots 17 along the inner perimeter of the walls assisted by an extension spring 34 attached between each blade leg end 37. The blades are maintained in stepped pockets 54 provided in the bottom face of the slotted hub 4, the communicating key is secured in an inset slot 52 disposed along the central axis of the arm provided between the slotted hub 4 and the pinion gear mounting platform 2. The key is maintained in communication with perpendicularly disposed rails 14 that are attached to the lower end of a planetary multiplier barrel 48 slidably captured in a semi-circular shoe 6, thus enabling the rails to extend from the top face of the pinion gear mounting platform adjacent the mounting pocket 2 through two spaced apart passageways 58 traveling into alignment with spaced apart arms extending perpendicular to the line of travel of the slide key 30.

Each rail 14 is provided with radial grooves 29 at one end of each rail and disposed to engage with arms 31 on the sliding key 30, thereby enabling capture or release of the planetary barrel 48 to enable engagement or retraction of the curved capture blades 36 into or out of slots 17 provide around the inner perimeter of the sector gear ratchet housing pivot pocket 23 defined by two spaced apart walls 22. This component allows the sector geared ratchet housing to accurately rotate around the slotted pivot hub 4 supporting smooth reciprocation of the components by precision radial alignment of the orchestrated components cooperate to lock or unlock the pivoted sector geared crowfoot into an operative position with the slotted circular hub 4 for reciprocating rotation while maintaining meshed gear tooth engagement of the sector geared ratchet housing 16 with the pinion drive gear 46. Once the grooves 29 at the end of each rail 14 are engaged, the mechanisms key 30 simultaneously locks the planetary drive and strain gauge module in a closed and latched position at its lowest extent 55 against the top face of the sector geared ratchet housing to hold the sector gear of the crowfoot against the top of the slotted pivot hub in the z-axis. With the lower outer rim 57 of the planetary multiplier contacting the top of the sector geared ratchet housing. When the forward nose of the key 30 contacts the bottom ends of pivoted curved blades 36 the blades pivot outwardly into slots 17 in the sector gear ratchet housing wall 22. Two forward parallel arms 32 of the key 30 extend slightly beyond the neck 8 of the slotted hub arm to provide a release handle for manual retraction of the capture mechanism. Sliding the two arms away from the slotted hub 4 at the front end of the tool causes the two pivoted blades 36 to retract inwardly withdrawing the curved blades from the inset radial slots 17 provided in the guide walls 22 of the sector geared ratchet housing 16. With the curved blades in a retracted position, the two components are separable into two individual components FIG. 4 for removal from a fitting. The capture mechanism is fitted with a bottom cover 3 that encloses all moving components into an inset pocket 52 and secured with screws 39 at the lower face of the slotted huh arm, the cover extends over the curved blades 36 extending to the rear end of the arm. Diametrically opposed slotted openings 59, avow the blades to extend outwardly to a position slightly outside the perimeter of the slotted hub annulus at a position adjacent to the upper face of the slotted hub.

Figure 7:
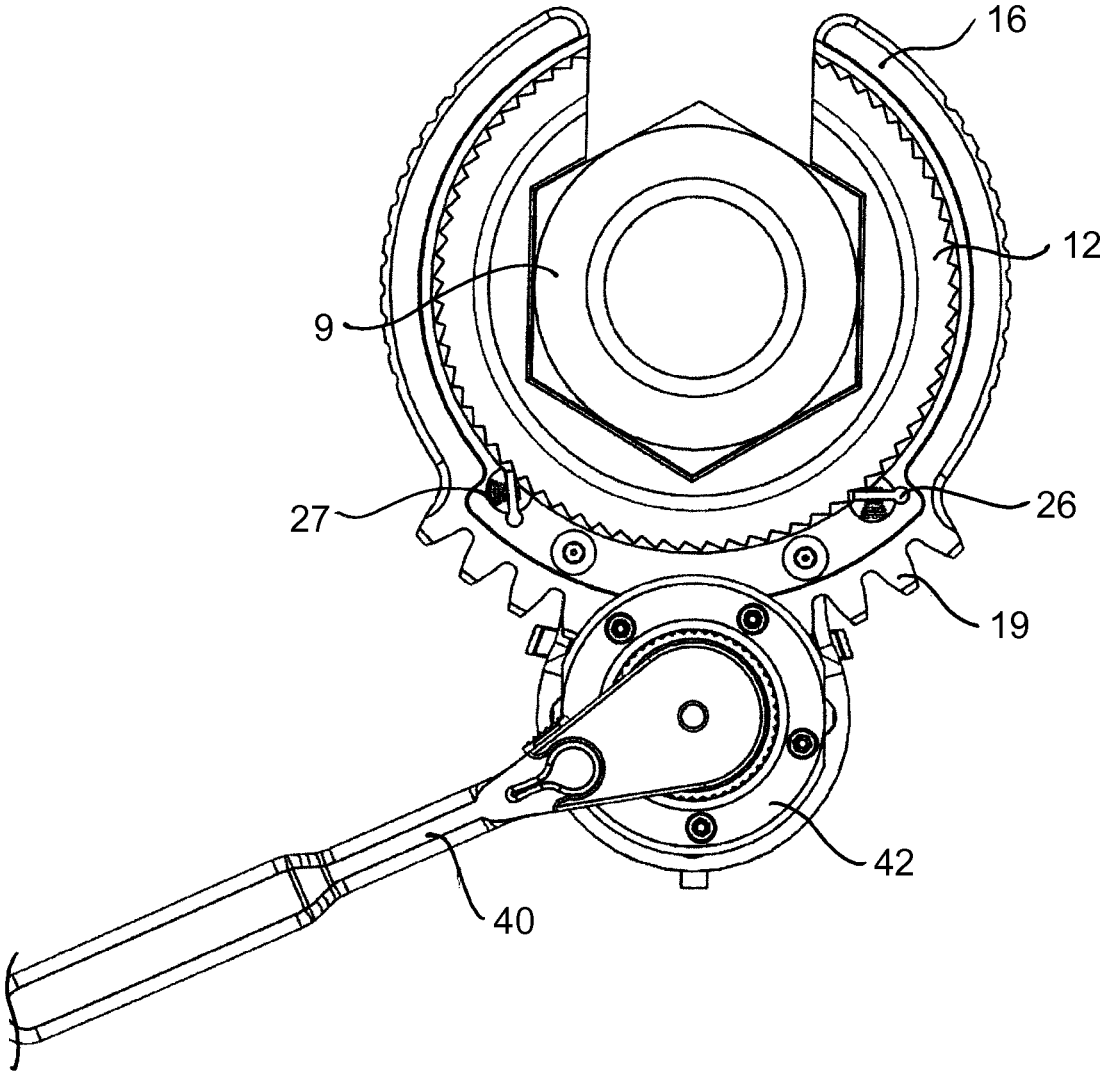
FIG. 7: Blades retracted without cover in place.
Figure 8:
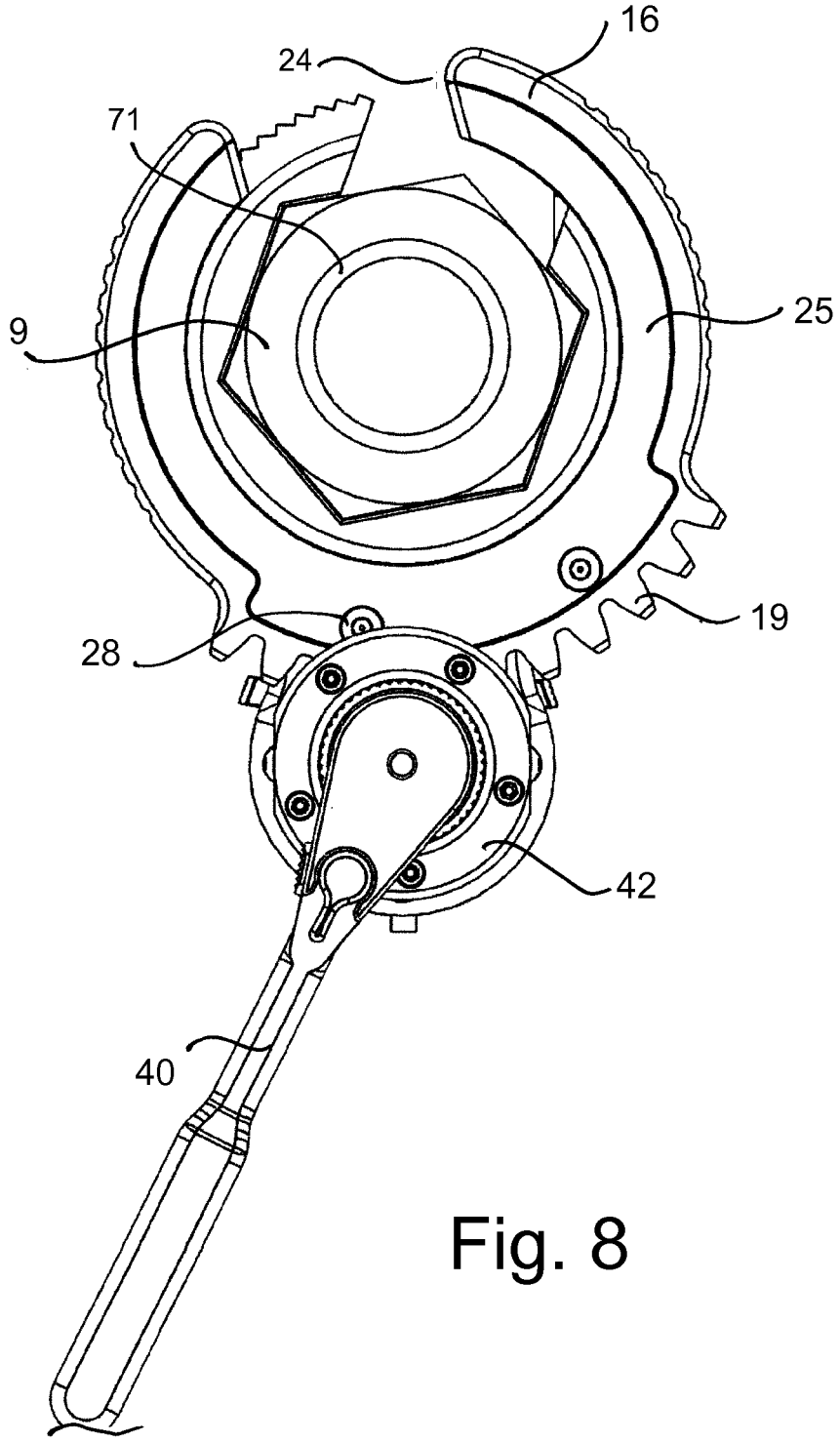
FIG. 8: Exploded view of first and second components

The slotted sector gear ratchet housing 16 is fitted with twin ratchet dogs 26 spaced apart a distance appropriate to establish a slotted entrance for a tube, pipe or line and provided with spring 27 biasing ratchet dogs 26, as seen in FIG. 7 for incrementally driving a slotted ratchet tooth drive wheel 12 gimbaled for rotation within a fitting receiving socket receiver 60 maintained within a pocket 15 in the sector geared ratchet housing 16 secured in place by a slotted top cover 25 securely attached with fasteners 28. The assembled unit is ready for placement onto the slotted circular pivot base or hub 4 and readied for driving engagement with a fitting 9. Thereby allowing reciprocative rotation of the input stem 41 in forward and rearward movements to drive the sector gear resulting in unidirectional ratchet advancements as small as 50 or as great as 600 per cycle. The ratchet wheel is provided with a hexagonal aperture 60 or socket receiver configured to rotate a socket within the ratchet wheel for driving engagement with a fitting. The torque multiplier is slidably held in a "C" shaped drive shoe 6. The planetary torque multiplier having an input sun gear 72 and three planetary gears 51 that are mounted in a planetary gear carrier 44 disposed inside a geared toothed barrel 49 defined by the lower part of the torque multiplier 48 assembly and supported in operative position with bearings 47A,B. The output shaft of the planetary gear carrier is equipped with a hex drive socket 45 for telescoping engagement with a shaft 61 driving the pinion gear in bearing at the arm opposite of the slotted hub (see phantom lines, FIG. 2). A commercially available strain gauge 42 module with digital readout is engaged with the input drive of the planetary torque multiplier 48 for measuring precise input values as they are applied to the planetary torque multiplier. The output drive 43 of the strain gauge is rotated with a common ratchet wrench 40, a hand wheel or a rigid bar.

The planetary torque multiplier 48 is slidably maintained in the "C" shaped shoe 6, which is attached to the top face of the distal end of the slotted hub arm 3. The shoe includes three interior lug shaped slots 62 extending from the face of the arm to the top of the shoe. The geared barrel 49 is provided with three corresponding lugs 63 around the perimeter of the barrel for engaging with slots 62 to prevent the rotation of the barrel relative to the shoe and to guide the coupling movement of the planetary torque multiplier 48 with the shoe.

What is claimed is:

1. A geared drive assembly for rotating a fitting, the fitting having a rotable feature and a non-rotable feature, the assembly comprising:

a slotted pivot hub having an opening defined by a pair of spaced-apart jaws at a first end and a receiver at a second end, wherein the opening is adapted to engage the non-rotatable feature of the fitting;

a ratchet housing pivotally secured to the slotted pivot hub, wherein the ratchet housing comprises a sector gear on an exterior circumference of the ratchet housing;

a drive gear subassembly positioned within the receiver of the slotted pivot hub, the drive gear subassembly comprising:

a torque multiplier having an upper portion with a drive input for operably engaging a driving tool, and a lower portion defining a geared barrel;

a planetary carrier having an input drive at a first end for operably engaging with the torque multiplier and a pinion gear at a second end for operably engaging the sector gear, the planetary carrier being encased by the geared barrel;

a plurality of rails each including a groove at a distal end thereof extending from an outer surface of the geared barrel through the slotted pivot hub, and a locking mechanism comprising a key reciprocatingly disposed on the slotted pivot hub between an engaged position and a disengaged position;

wherein in the engaged position the locking mechanism engages the ratchet housing to secure and maintain an alignment of the slotted pivot hub and the ratchet housing and the key engages said grooves of the plurality of rails to lock the torque multiplier and the planetary carrier with the slotted pivot hub, thereby preventing decoupling of the drive gear subassembly from the receiver of the slotted pivot hub;

wherein the pinion gear meshes with the sector gear, causing rotation of the ratchet housing when the input drive is rotated.

2. The assembly of claim 1, further comprising:

a ratchet wheel having an inner surface adapted to engage the rotable feature of the fitting, wherein the ratchet wheel is pivotally secured on an inner surface of the ratchet housing to allow rotation within the ratchet housing in at least one direction.

3. The assembly of claim 2, further comprising:

a plurality of ratchet teeth disposed on an exterior of the ratchet wheel;

a spring biased pivoted ratchet dog attached to the ratchet housing, wherein the ratchet dog contacts the plurality of ratchet teeth, thereby translating reciprocating rotation of the ratchet housing engaged with the pinion gear to incrementally advance the ratchet wheel.

4. The assembly of claim 1, wherein the opening that engages the non-rotable feature of the fitting, is non-circular.

5. The assembly of claim 1, wherein the key is disposed on a bottom surface of the slotted pivot hub.

6. The assembly of claim 1, wherein the drive gear subassembly further comprises:

a planetary gear set in mechanical engagement with the planetary carrier.

7. The assembly of claim 6, wherein the planetary gear set causes an increase in a torque exerted by the pinion gear compared to the torque applied to the drive input.

8. The assembly of claim 1, wherein a mechanical advantage provided by the pinion drive gear engaged with the sector gear is about 5 to 1.

9. The assembly of claim 1, wherein a mechanical advantage provided by the pinion drive gear engaged with the sector gear is less than 5 to 1.

10. The assembly of claim 1, wherein a mechanical advantage provided by the pinion drive gear engaged with the sector gear is greater than 5 to 1.

11. The assembly of claim 1, further comprising:

a pair of arcuate walls extending from a bottom plane of the ratchet housing, wherein the pair of arcuate walls slidingly engage an exterior surface of the spaced-apart jaws of the slotted pivot hub, thereby maintaining axial alignment of the slotted pivot hub with the ratchet housing as the ratchet housing is rotated by the pinion gear.

12. The assembly of claim 11, wherein the locking mechanism further comprises:

a pair of retractable blades attached to the slotted pivot hub, wherein the pair of retractable blades are adapted to rotatably engage a pair of radial slots disposed on the pair of arcuate walls.

13. The assembly of claim 1, further comprising:

a plurality of passages formed in the slotted pivot hub for the plurality of rails to extend therethrough.

14. The assembly of claim 1, further comprising:

a plurality of slots arranged in parallel and traversing a line from a first end of the receiver to a second end of the receiver, a plurality of lugs disposed on an exterior of the geared barrel, wherein each of the plurality of lugs slidingly engages a corresponding slot of the plurality of slots to prevent rotation of the drive gear subassembly within the receiver.

15. The assembly of claim 1, wherein the receiver is a "C" shaped shoe.

* * * * *